US008356812B2

(12) United States Patent
Moehringer et al.

(10) Patent No.: US 8,356,812 B2
(45) Date of Patent: Jan. 22, 2013

(54) APPARATUS FOR CORRECTING THE POSITION OF SHEETS

(75) Inventors: Markus Moehringer, Weinheim (DE); Burkhard Wolf, Dossenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 45 days.

(21) Appl. No.: 12/912,307

(22) Filed: Oct. 26, 2010

(65) Prior Publication Data

US 2011/0094401 A1 Apr. 28, 2011

(30) Foreign Application Priority Data

Oct. 27, 2009 (DE) ..... 10 2009 050 752

(51) Int. Cl.
*B65H 7/02* (2006.01)

(52) U.S. Cl. ..... 271/227; 271/277

(58) Field of Classification Search ..... 271/226, 271/228, 275, 277; 101/410, 246
See application file for complete search history.

(56) References Cited

U.S. PATENT DOCUMENTS

| | | | | |
|---|---|---|---|---|
| 4,290,595 | A * | 9/1981 | Thunker | 271/277 |
| 4,821,643 | A | 4/1989 | Wieland | |
| 6,912,952 | B1 * | 7/2005 | Landa et al. | 101/230 |

FOREIGN PATENT DOCUMENTS

| | | | |
|---|---|---|---|
| DE | 4227941 | A1 | 2/1994 |
| DE | 102006061431 | A1 | 6/2008 |
| EP | 0311924 | A2 | 4/1989 |

OTHER PUBLICATIONS

German Search Report dated Jul. 19, 2010.

* cited by examiner

*Primary Examiner* — Michael McCullough
(74) *Attorney, Agent, or Firm* — Laurence A. Greenberg; Werner H. Stemer; Ralph E. Locher

(57) ABSTRACT

In an apparatus for correcting a position of a sheet which is transported in the grip of grippers on a feed drum of a sheet processing machine, in particular a sheetfed rotary printing press, provision is made for a gripper device of the drum to be mounted in independently rotatable arranged supports and for it to be possible for each support to be driven by a step-up gear mechanism.

8 Claims, 3 Drawing Sheets

APPARATUS FOR CORRECTING THE POSITION OF SHEETS

CROSS-REFERENCE TO RELATED APPLICATION

This application claims the priority, under 35 U.S.C. §119, of German application DE 10 2009 050 752.3, filed Oct. 27, 2009; the prior application is herewith incorporated by reference in its entirety.

BACKGROUND OF THE INVENTION

Field of the Invention

The invention relates to an apparatus for correcting the position of sheets which are transported in the grip of grippers on a cylinder or a drum of a sheet processing machine.

An apparatus of the generic type is disclosed by published, non-prosecuted German patent application DE 10 2006 061 431 A1. This document shows a cylinder of a sheet processing machine having a gripper device for fixing a sheet front edge. The gripper device is connected to the cylinder by resiliently deformable flexible webs, so that the gripper device can be set obliquely with respect to the cylinder, which permits the correction of an oblique position of the fixed sheet.

SUMMARY OF THE INVENTION

It is accordingly an object of the invention to provide an apparatus for correcting the position of sheets which overcome the above-mentioned disadvantages of the prior art devices of this general type, which corrects the position of a sheet beyond the possibility of oblique position correction, and also permits a correction of the position of the sheet in the circumferential direction.

With the foregoing and other objects in view there is provided, in accordance with the invention an apparatus for correcting a position of a sheet transported in a sheet processing machine. The apparatus contains a step-up gear mechanism, a drum having supports being rotatably mounted independently of one another and in each case being driven by the step-up gear mechanism, and a gripper device for fixing the sheet being mounted in the supports. The gripper device transports the sheet.

The substantial advantage of the invention is to be seen in the arrangement of a gear mechanism or a gear mechanism on each side of the cylinder or of the drum for the activation of the gripper device. The gear mechanism makes it possible for a sheet which is transported on a cylinder or a drum in the grip of grippers to be aligned, as it is transported, both in the transport direction and also with respect to its oblique position such that it can be transferred very accurately to the next gripper system in a defined intended position. The actual transport movement of the cylinder is coupled via mechanical components (e.g. gears) to the main drive of the sheet processing machine. As a result, the rotational oscillations of the overall machine are also transmitted to the cylinder. Only the movement with which the deviation of the sheet edge from the intended position is corrected is introduced by direct drives via a gear mechanism. Furthermore, it is possible with this apparatus to align the sheet with respect to its lateral position transversely to the sheet running direction.

In a particularly advantageous refinement, the gear mechanisms are formed as step-up gear mechanisms, in particular planet gear mechanisms.

Other features which are considered as characteristic for the invention are set forth in the appended claims.

Although the invention is illustrated and described herein as embodied in an apparatus for correcting the position of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
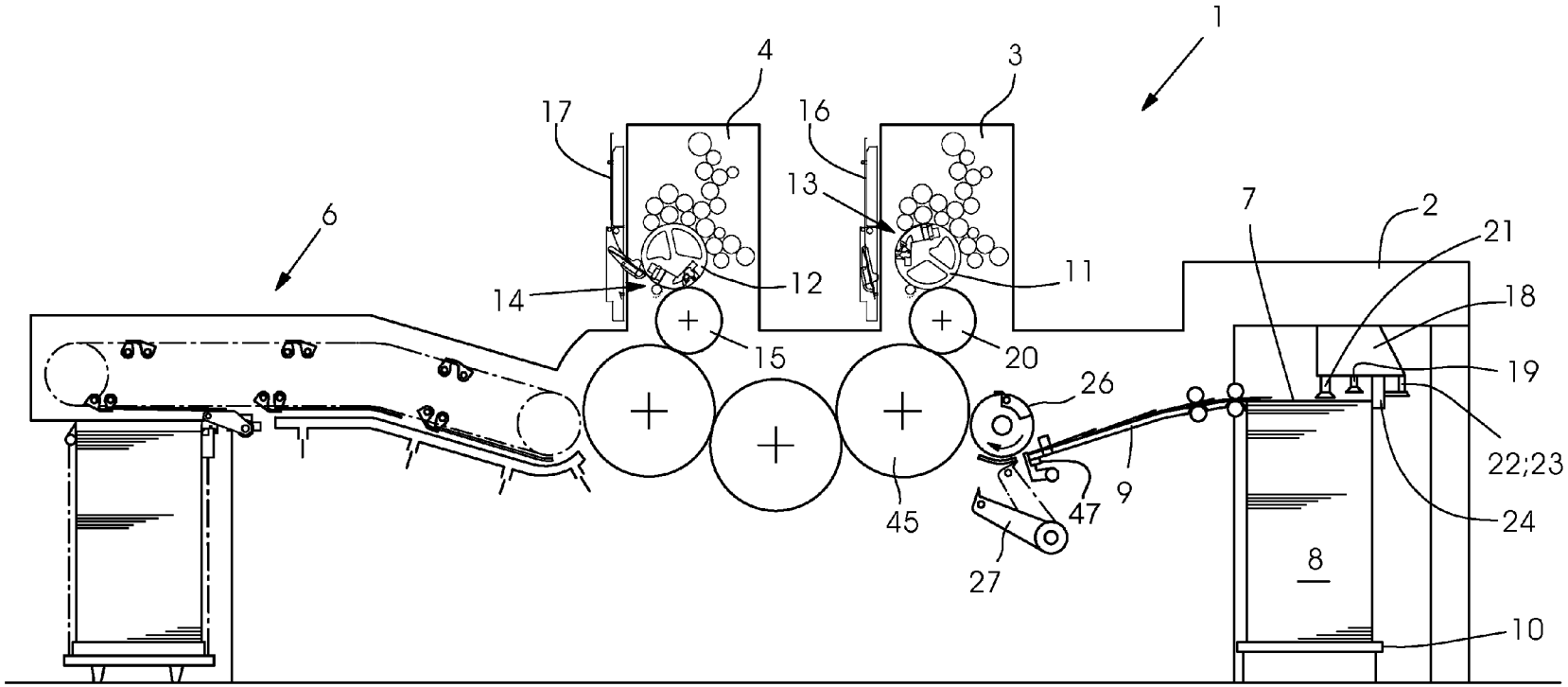
FIG. 1 is an illustration of a sheetfed rotary press in section according to the invention.

Referring now to the figures of the drawing in detail and first, particularly, to FIG. 1 thereof, there is shown a machine for processing sheets 7, e.g. a printing press 1, that has a feeder 2, at least one printing unit 3 and 4 and a deliverer 6. The sheets 7 are removed from a sheet stack 8 and, separated or overlapping, are fed over a feed table 9 to the printing units 2 and 4. The latter each contain a plate cylinder 11, 12 in a known manner. The plate cylinders 11 and 12 each have an apparatus 13, 14 for fixing flexible printing plates. Furthermore, each plate cylinder 11, 12 is assigned an apparatus 16, 17 for semiautomatic or fully automatic printing plate changer.

The sheet stack 8 lies on a stack plate 10 which can be raised under control. The sheets 7 are removed from the upper side of the sheet stack 8 by what is known as a suction head 18 which, inter alia, has a number of lifting and dragging suckers 19, 21 for separating the sheets 7. Furthermore, blowing devices 22 are provided for loosening the upper sheet layers, as are sensing elements 23 for stack tracking. In order to align the sheet stack 8, in particular the upper sheets 7 of the sheet stack 8, a number of side and rear stops 24 are provided.

Alignment of the sheets 7 before the first processing station, for example the printing unit 3, is carried out on a first cylinder or drum, for example a feed drum 26. A transfer of the sheet 7 from the feed table 9 to the feed cylinder 26 is carried out in the exemplary embodiment according to FIG. 1 by what is known as an oscillating pre-gripper 27. The transfer of the sheet 7 can, however, also be carried out in another way, e.g. by a linearly driven gripper device.

Figure 2:
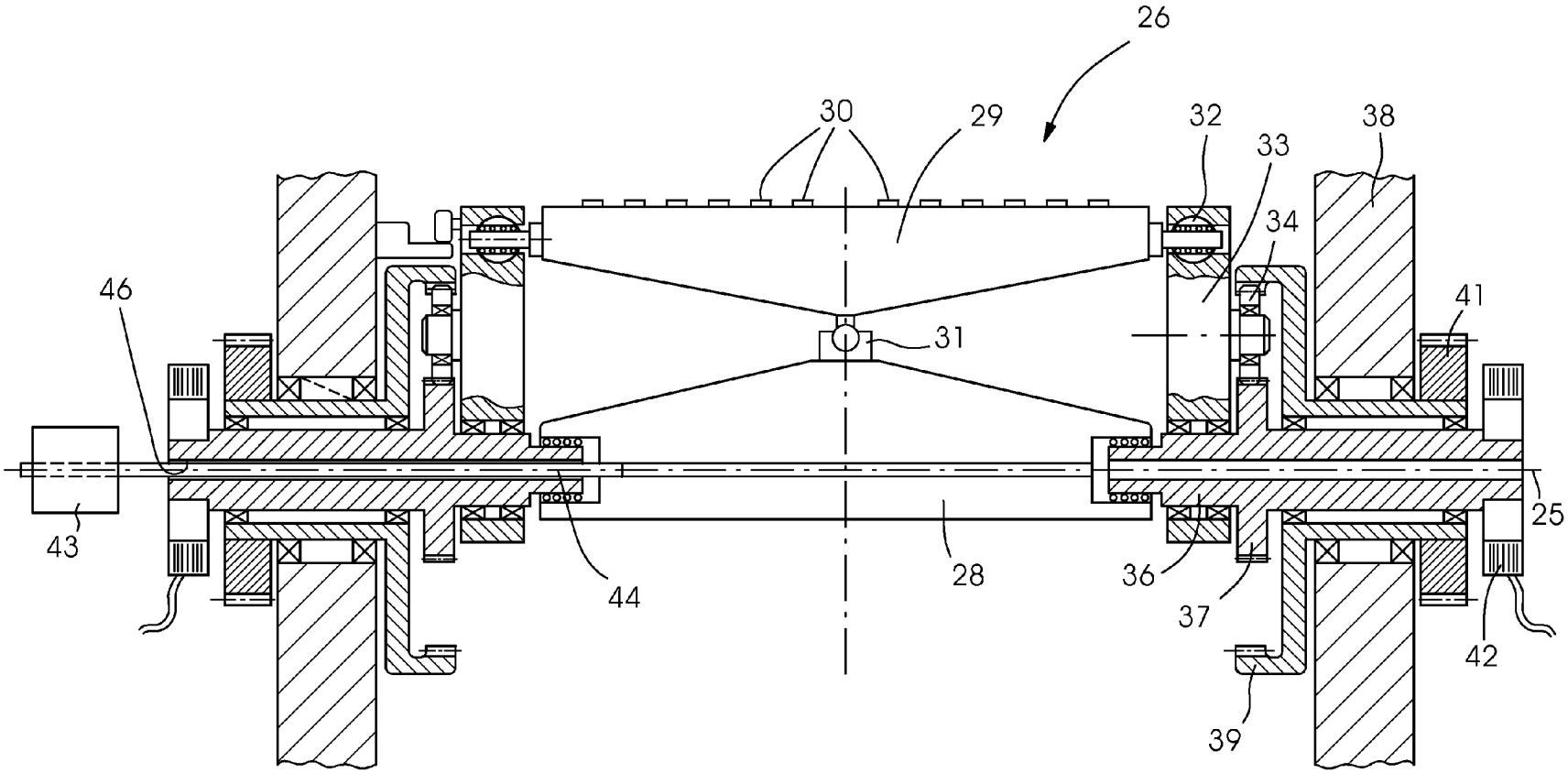
FIG. 2 is a diagrammatic, sectional view of a sheet transport drum having an adjustable gripper device for correcting a sheet position.
Figure 3:
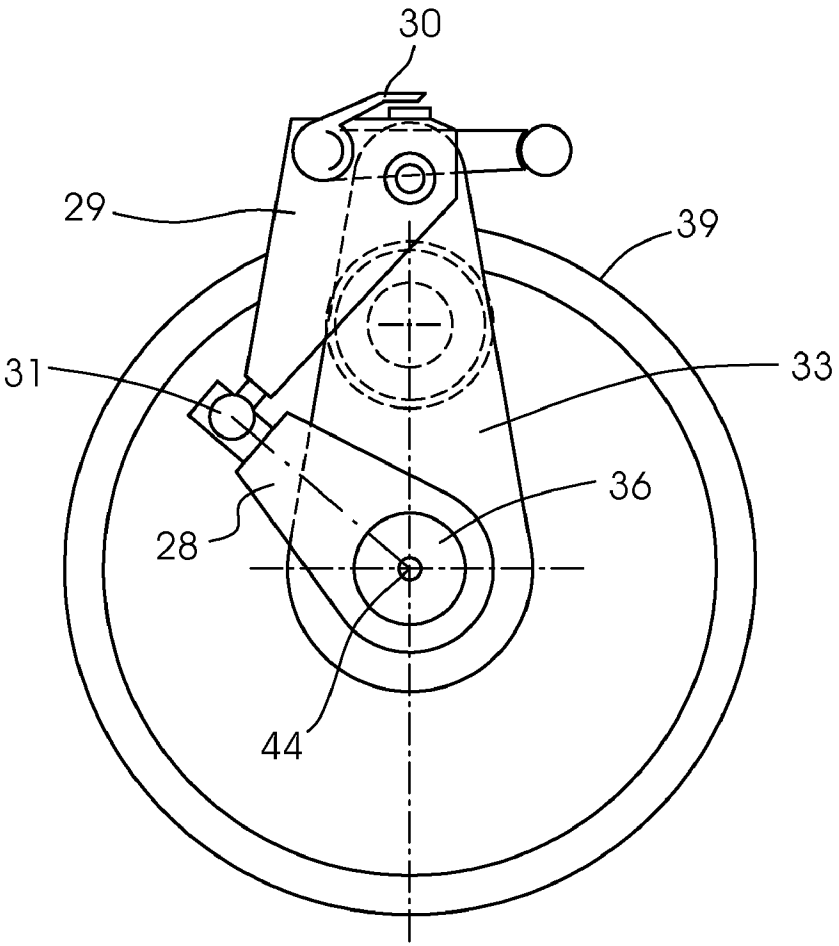
FIG. 3 is a diagrammatic, side view of the sheet transport drum.

As shown in FIGS. 2 and 3, the feed drum 26 contains a rotatably mounted base body 28 and a gripper bar 29 coupled thereto. By use of a coupling joint 31 arranged approximately centrally, the gripper bar 29 is arranged such that it can be pivoted with respect to the base body 28 in and counter to the sheet transport direction—in a circumferential direction of the drum. The gripper bar 29 bears a number of grippers 30 arranged beside one another at intervals for holding a sheet during a transport phase by the feed drum 26.

The gripper bar 29 is mounted on both sides by sliding ball joints 32 in rotatably mounted supports, for example planet gear supports 33, and in the region of an axis of rotation 25 of the feed drum 26 on ends of drive shafts 36.

The supports 33 in each case have a drive gear 34, what is known as a planet gear, and are in each case rotatably mounted on drive shafts 36 (sun gear shaft). The drive shafts 36 in each case have a drive gear 37 (sun gear), which meshes with a planet gear 34. Furthermore, the planet gears 34 mesh with internal gears 39 which are rotatably mounted in side frames 38 of the sheet processing machine 1 and which in each case can be driven at the cycle rate of the sheet processing machine 1 by drive gears 41, for example by meshing with a non-illustrated gear train belonging to the machine 1.

The sun gear shafts 36 are in each case arranged such that they can be driven by an actuating motor 42.

A further actuating motor 43 is connected to the base body 28 by a rod 44. Here, the rod 44 is arranged in an axial bore 46 in the sun gear shaft 36. Via the rods 44, the actuating motor 43 produces a lateral deflection of the base body 28 and therefore a lateral displacement of the gripper bar 29 coupled thereto.

If, by sensors 47, an erroneous position of a sheet is determined, the actuating motors 42, 43 are fed with corrective values, for example by a machine control system, which leads to an activation of the actuating motors 42, 43.

In the event of an erroneous position of a sheet in relation to the circumferential alignment thereof (in or counter to the sheet transport direction), the actuating motors 42 are activated synchronously. By this measure, the planet gears 34 meshing with the sun gears 37 are driven more quickly or more slowly with respect to the drive gear 41, so that, depending on the direction of rotation of the actuating motors 42, the gripper bar 27 has superimposed on it a speed which leads to a lead or lag of the gripper bar 29 with respect to the gear train of the machine 1 and thus with respect to the following cylinder, for example printing cylinder 45.

An activation of the further actuating motor 43 for the lateral position correction, carried out following an intended value-actual value comparison, leads to a lateral displacement of the base body 28 and thus to the lateral displacement of the gripper bar 29 and of the sheet 7 held by the grippers 30 of the gripper bar 29.

In the event of an oblique position of the sheet, in order to correct the oblique position either the actuating motor 42 is driven in or counter to the direction of rotation of the drum 26 or the two actuating motors 42 are driven in the opposite direction of rotation.

The invention claimed is:

1. An apparatus for correcting a position of a sheet transported in a sheet processing machine, the apparatus comprising:

a step-up gear mechanism;

a sensor for detecting a position of the sheet;

a drum having supports being rotatably mounted independently of one another and in each case being driven by said step-up gear mechanism; and a gripper bar for fixing the sheet, said gripper bar being mounted in said supports, said gripper bar for correcting an oblique position as detected by said sensor, and said gripper bar transporting the sheet.

2. The apparatus according to claim 1, further comprising sliding ball joints;

a coupling joint;

said drum has a base body; and said gripper bar has a number of grippers disposed beside one another at intervals, and is mounted in said supports by means of said sliding ball joints, and is coupled to said base body of said drum by said coupling joint.

3. The apparatus according to claim 2, further comprising drive shafts having ends, said base body is mounted on said ends of said drive shafts such that said base body can rotate about an axis of rotation of said drum.

4. The apparatus according to claim 2, further comprising an actuating motor having a rod for laterally displacing said gripper bar and for acting on said base body of said drum by means of said rod.

5. The apparatus according to claim 1, wherein said step-up gear mechanism has planet gear mechanisms.

6. The apparatus according to claim 5, wherein said planet gear mechanisms each have an internal gear driven at a cycle rate of the sheet processing machine;

further comprising planet gears;

further comprising drive shafts for driving said planet gears; and further comprising actuating motors each driving one of said drive shafts.

7. The apparatus according to claim 6, wherein said actuating motors can be driven by a computer of a machine control system of the sheet processing machine following an intended value-actual value comparison of positioning data of the sheet to be transported.

8. A sheet fed rotary printing press, comprising:

an apparatus for correcting a position of a sheet in the sheetfed rotary printing press, said apparatus containing:

a step-up gear mechanism;

a sensor for detecting a position of the sheet;

a drum having supports being rotatably mounted independently of one another and in each case being driven by said step-up gear mechanism; and a gripper bar for fixing the sheet, said gripper bar being mounted in said supports, said gripper bar for correcting an oblique position as detected by said sensor, and said gripper bar transporting the sheet.

* * * * *